US011358266B2

(12) United States Patent
Noble et al.

(10) Patent No.: US 11,358,266 B2
(45) Date of Patent: Jun. 14, 2022

(54) MULTI-TOOL FOR UTILITY ENGINEERS

(71) Applicant: Puget Sound Energy, Bellevue, WA (US)

(72) Inventors: Joseph T. Noble, North Bend, WA (US); Shawn Densmore Reed, Tacoma, WA (US)

(73) Assignee: PUGET SOUND ENERGY, INC., Bellevue, WA (US)

( * ) Notice: Subject to any disclaimer, the term of this patent is extended or adjusted under 35 U.S.C. 154(b) by 0 days.

(21) Appl. No.: 17/125,873

(22) Filed: Dec. 17, 2020

(65) Prior Publication Data

US 2021/0260744 A1 Aug. 26, 2021

Related U.S. Application Data

(60) Provisional application No. 62/980,975, filed on Feb. 24, 2020.

(51) Int. Cl.

| | |
|---|---|
| ***B25D 1/04*** | (2006.01) |
| ***B25F 1/00*** | (2006.01) |
| ***B66F 15/00*** | (2006.01) |
| ***B25F 1/02*** | (2006.01) |

(52) U.S. Cl.
CPC ..... *B25F 1/006* (2013.01); *B25F 1/02* (2013.01); *B66F 15/00* (2013.01)

(58) Field of Classification Search
CPC ..... B25F 1/006; B25F 1/02; B66F 15/00
USPC ..... 7/143, 138, 146, 167
See application file for complete search history.

(56) References Cited

U.S. PATENT DOCUMENTS

| | | | | |
|---|---|---|---|---|
| 1,018,172 | A * | 2/1912 | Downs | B25B 23/0021 81/177.2 |
| 1,417,725 | A * | 5/1922 | Fullenwider | B25F 1/02 7/143 |
| 1,689,585 | A * | 10/1928 | Haschart | B25F 1/00 81/125.1 |
| 6,062,115 | A * | 5/2000 | Bares | B25B 23/1427 81/477 |
| 6,449,789 | B1 * | 9/2002 | Krass | B25B 15/00 7/138 |
| D626,810 | S | 11/2010 | Steineckert et al. | |

(Continued)

FOREIGN PATENT DOCUMENTS

| | | |
|---|---|---|
| CN | 202412234 U | 9/2012 |
| CN | 203696856 U | 7/2014 |

OTHER PUBLICATIONS

WIPO Global Design Database, A world-wide collection of industrial designs data; including WIPO Hague registrations and information from participating national offices, Sep. 28, 2019, 3 pages.

*Primary Examiner* — Joseph J Hail
*Assistant Examiner* — Shantese L McDonald
(74) *Attorney, Agent, or Firm* — Fountainhead Law Group P.C.

(57) ABSTRACT

The present disclosure includes a multi-tool including a handle having a first and a second end opposite the first end and a hammer face attached at the first end of the handle. A pry bar is attached at the first end of the handle along with a lifting hook. A vault key is attached at the second end of the handle. The lifting hook may extend from the first end of the handle or may be formed as a groove or cutout in the first end of the handle or in the pry bar.

16 Claims, 9 Drawing Sheets

(56) References Cited

U.S. PATENT DOCUMENTS

| | | | | |
|---|---|---|---|---|
| 8,117,702 | B2 * | 2/2012 | Woolley | B25F 1/006 7/146 |
| 8,707,489 | B1 * | 4/2014 | Huhn | B25B 13/06 7/138 |
| 9,138,881 | B2 | 9/2015 | Canpiraoli et al. | |
| 10,124,478 | B2 | 11/2018 | Nicholls | |
| 2008/0264211 | A1 | 10/2008 | Unda et al. | |

* cited by examiner

312

MULTI-TOOL FOR UTILITY ENGINEERS

CROSS-REFERENCE TO RELATED APPLICATION

This non-provisional patent application claims the benefit of U.S. Provisional Patent Application No. 62/980,975, filed Feb. 24, 2020, which is incorporated by reference herein in its entirety.

BACKGROUND

The present disclosure relates generally to multi-tools, and more specifically to multi-tools for use by utility engineers.

A utility engineer is an engineer that works for a utility company, such as a water, gas, or electric utility company to design, implement, and maintain infrastructure of the utility. This infrastructure may include water or gas mains, electrical grids, and other types of delivery systems, as well as communications systems, required by the utility company to supply to end users the services provided by the utility. Electrical utility engineers, for example, have recurring tasks and pieces of equipment that they encounter in their typical work duties. These tasks may include hammering stakes or other components, opening and closing doors of vaults housing electrical equipment, and unlocking these vault doors to gain access to the electrical equipment contained therein. As a result, an electrical utility engineer must carry multiple tools to perform the tasks that are typically encountered. This can result in tools being forgotten or lost, and may necessitate multiple trips between a maintenance truck carrying the tools and a jobsite at which work is to be performed in order to deliver all the required tools to the job site.

In general, it would be advantageous for utility engineers to have improved tools for performing the tasks required as part of their typical work duties.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In the following description, for purposes of explanation, numerous examples and specific details are set forth in order to provide a thorough understanding of the present disclosure. It will be evident, however, to one skilled in the art that the present disclosure as expressed in the claims may include some or all of the features in these examples, alone or in combination with other features described below, and may further include modifications and equivalents of the features and concepts described herein.

Figure 1:
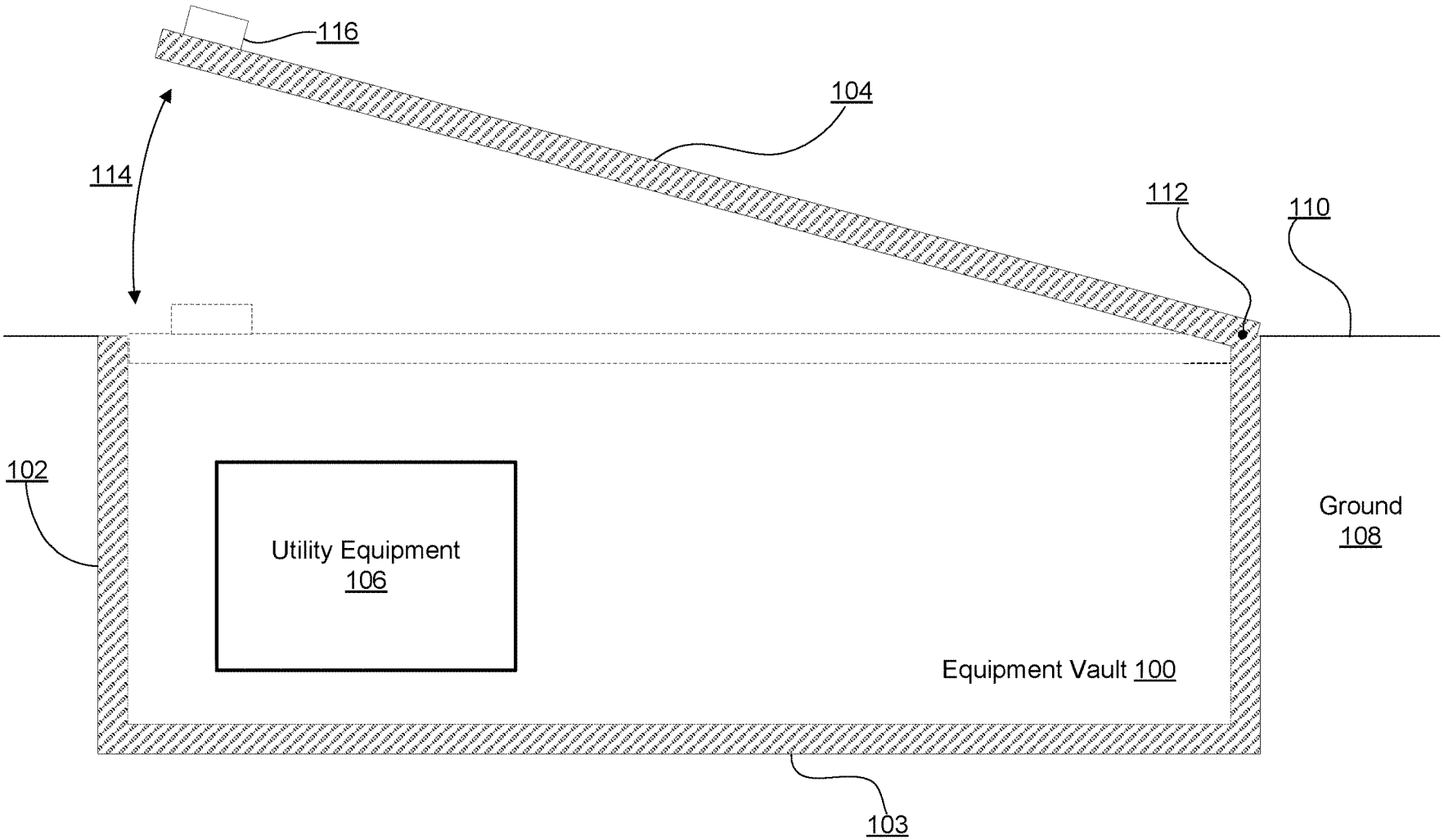
FIG. 1 is a cross-sectional view of a generic equipment vault housing utility equipment that must occasionally be accessed by utility engineers.

FIG. 1 is a cross-sectional view of a generic equipment vault 100 housing utility equipment that must occasionally be accessed by utility engineers. The equipment vault 100 includes walls 102, a bottom 103, and a vault door 104 enclosing an interior of the equipment vault. Utility equipment 106 for performing functions related to the business operations of the utility are housed in the interior of the equipment vault 100. In many situations, the equipment vault 100 is located below ground 108 as shown in the example of FIG. 1. The door 104 of the vault is approximately at or level with a surface 110 of the ground when closed, which is illustrated in FIG. 1 through the dashed line depiction of the door. To gain access to the utility equipment 106 in the vault 100, a utility engineer must open the vault by lifting the door 104. The door 104 is attached at one end, such as through a hinge (not shown), to one of the walls 102, and rotates about an axis 112 when opened and closed as indicated by the arrow 114 in FIG. 1.

Equipment vaults 100 are many times relatively large structures in order to have enough space on the interior to house the required equipment 106 within the vault. Thus, the door 104 may be relatively large. In addition, the door 104 must be strong enough to support the weight of a person or persons walking across the door when closed and level with the surface 110 of the ground 108. The door 104 also must provide security for the equipment vault 100 to prevent unauthorized individuals from opening the door 104 and gaining access to the utility equipment 106. The door 104 typically includes an access device 116 contained at the end of the door opposite the hinged end that rotates about the axis 112. The access device 116 provides two functions. First, the access device provides security for the vault in the form of a suitable locking mechanism (not shown) configured to receive a suitable vault key. The utility engineer must accordingly have the required vault key to unlock the locking mechanism prior to opening the vault door 104.

In addition to providing security, the access device 116 also provides attachment functionality to enable the utility engineer to physically open the unlocked door 104. The access device 116 includes a suitable attachment mechanism (not shown) that allows the utility engineer to attach a lifting tool (not shown) to the attachment mechanism. The door 104 may be relatively large and heavy and thus the engineer must utilize such a suitable lifting tool to open the door. A typical lifting tool has one end configured to attach to the attachment mechanism of the access device 116 and an opposite end having a suitable grip or handle that is grasped by the engineer. In operation, the utility engineer attaches the lifting tool to the attachment mechanism and then grasps the handle of tool and pulls the tool upward to rotate the door 104 clockwise about the axis 112 and thereby open the door. The access device 116 functionally represented in FIG. 1 as a single component but would typically be formed by separate physical components that provide the required functionality.

As will be understood from the above description, to open the vault door 104 a utility engineer must carry the vault key for unlocking the locking mechanism of the access device 116. The utility engineer must also carry the lifting tool for thereafter opening the unlocked vault door 104. Additional tools may also be required for use in opening the vault door 104, and for use in performing the required operations on the utility equipment 106 within the vault 100 once the door has been opened. For example, the vault door 104 and components of the access device 116 are typically formed of metal and the vault 100 located outdoors. Thus, rust may form on these components, which may require the utility engineer to utilize another tool such as a hammer to disengage components from the rusted state when opening the vault door 104. Other common tasks must be regularly performed by utility engineers that require associated tools for performing these tasks, resulting the utility engineer need to carry and have on hand a relatively large number of tools. Embodiments of the present disclosure are directed to a single multi-tool that provides a single tool the engineer may carry and utilize for performing multiple functions commonly encountered by the utility engineer, as will be described in more detail below with reference to FIGS. 2-17.

Figure 2A:
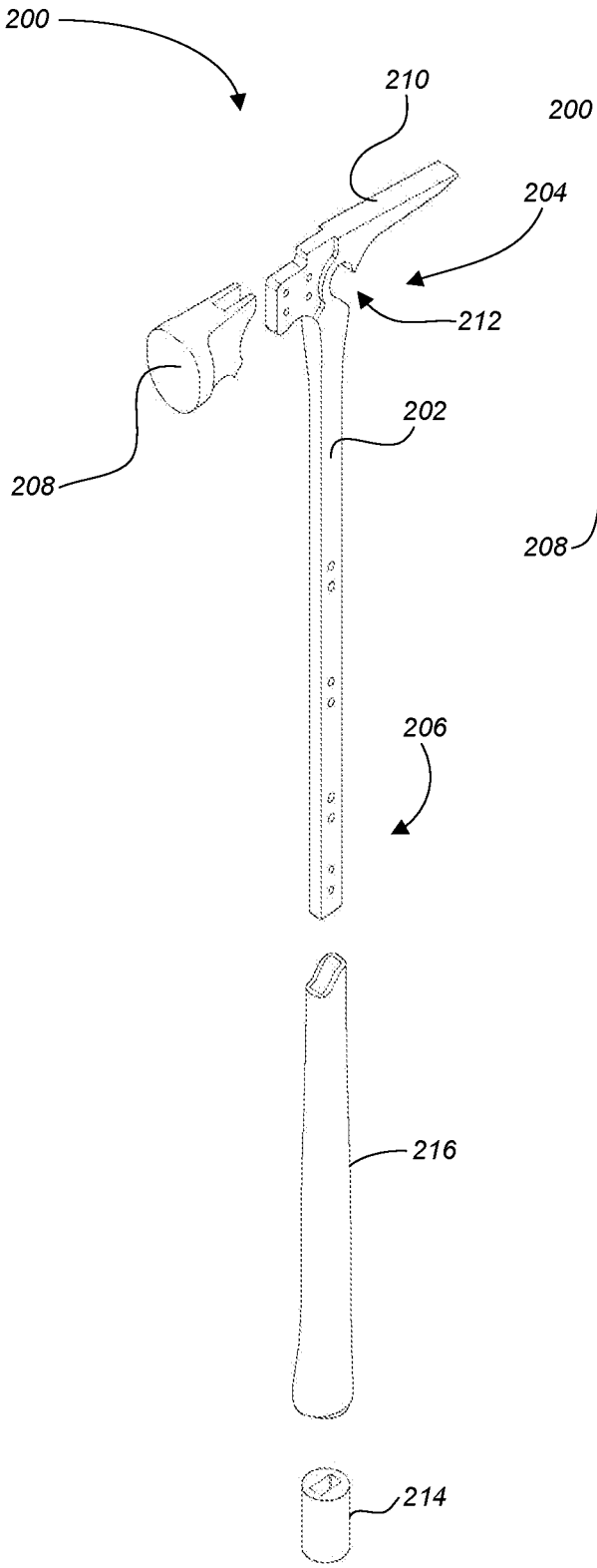
FIG. 2A is an exploded perspective view of a multi-tool for use in accessing the equipment vault of FIG. 1 according to one embodiment of the present disclosure.
Figure 2B:
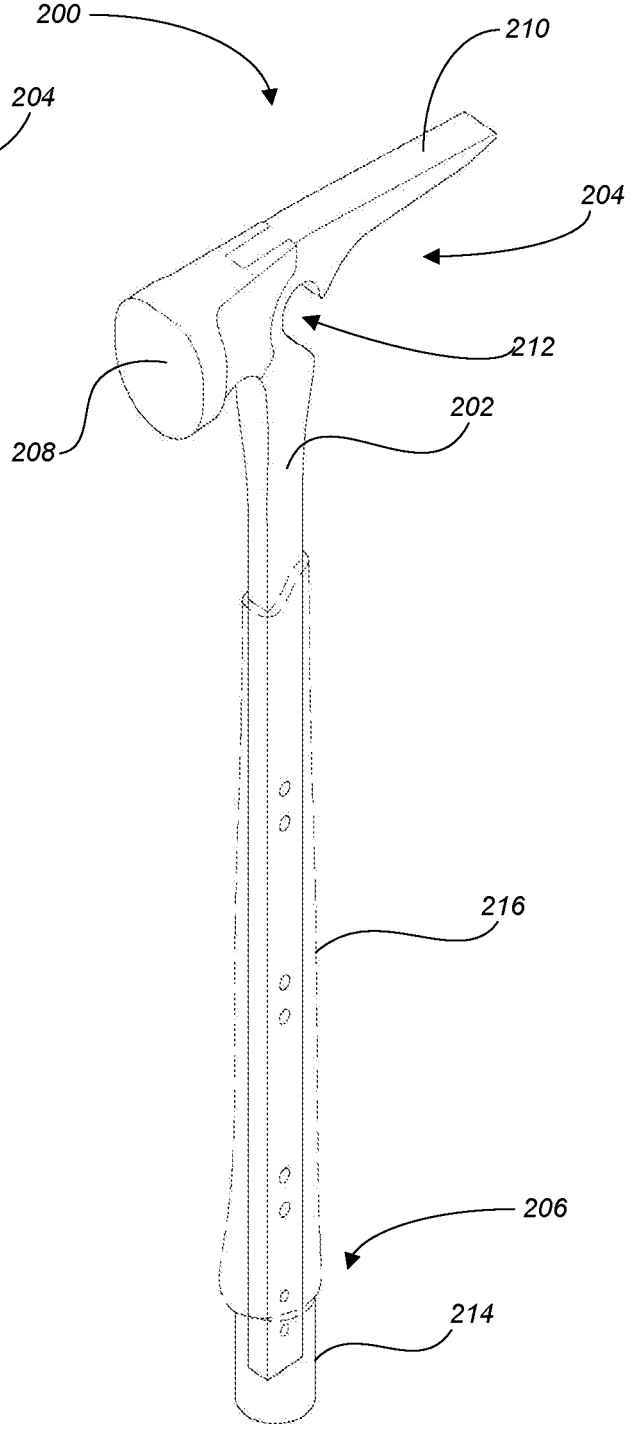
FIG. 2B is a perspective view of the multi-tool of FIG. 2A when the multi-tool has been assembled according to one embodiment of the present disclosure.

FIG. 2A is an exploded perspective view and FIG. 2B is an assembled perspective view of a multi-tool 200 for use in accessing the equipment vault 100 of FIG. 1 according to one embodiment of the present disclosure. A multi-tool is a hand tool that combines "multiple" functions of several individual tools into a single tool. The multi-tool 200 includes components for performing the functions of several of the individual tools most utilized by a utility engineer according to one embodiment of the present disclosure. Integrating the functionality of these multiple tools into the single multi-tool 200 reduces fatigue and stress on the utility engineer in bringing and carrying multiple individual tools at once. Eliminating the need for the utility engineer to bring in carry multiple individual tools improves the situational awareness of the engineer on a jobsite, increasing the safety of the engineer. In addition, the single multi-tool 100 has a lower cost than all the individual tools the multi-tool replaces, reducing the tool cost per utility engineer for the utility company.

The multi-tool 200 includes a handle 202 having a first end 204 and a second end 206 opposite the first end. A hammer face 208 is attached at the first end 204 of the handle 202 along with a pry bar 210. A lifting hook 212 is also attached or formed at the first end 204 of the handle 202, where in the embodiment of FIGS. 2A-2H the lifting hook is formed as a groove or cut out in a lower portion of the pry bar 210. The lifting hook 212 may described herein as being part of the handle 202 at the first end 204, or may be described as being part of the pry bar 210 at the first end of the handle. An enclosure or vault key 214 is attached at the second end 206 of the handle 202 and is utilized by utility engineer to unlock an enclosure or vault containing equipment being serviced by the utility engineer. The vault key 214 may be permanently attached to the second end 206 of the handle 202, or may be formed at the second end as an integral part of the handle. Alternatively, the vault key may be removably attached at the second end 206 of the handle 202, which enables different vault keys to be placed on the second end of the handle as required for opening different equipment vaults 100. A grip 216 is grasped by a utility engineer when utilizing the multi-tool 200 and is attached to surround a portion of the handle 202. The grip 216 is shown through a dashed line in FIG. 2B. The handle 202, and components thereof, is formed from a suitable material, such as metal, and similarly the grip 216 is formed from a suitable material.

The handle 202 includes a body extending between the first end 204 and second end 206 of the handle, and the grip 216 is attached to this body of the handle. The body of the handle 202 is shown as including a number of holes in the embodiment of FIGS. 2A and 2B but in other embodiments the handle does not include any such holes. The holes in the body of the handle 202 are configured to receive securing devices, such as screws, that are utilized to secure the grip 216 to the body of the handle. In other embodiments the body of the handle 202 includes no holes. The grip 216 in such embodiments is formed from a suitable material and is sized such that the grip fits over the body of the handle and is secured in place on the body through forces developed between the grip and body.

The multi-tool 200 may be utilized to open and close equipment vault doors such as the vault door 104 of the equipment vault 100 of FIG. 1. To do so a utility engineer would first utilize the vault key 214 to unlock the locking mechanism of the access device 116. The engineer could grasp the tool 200 in a variety of different ways while using the vault key 214, such as grasping the multi-tool at the first end of 204 of the handle 202 or hold the device with two hands on the handle. After unlocking the locking mechanism of the access device 116, the utility engineer would engage the lifting hook 212 with the attachment mechanism of the access device 116. The attachment mechanism of the access device 116 would, of course, have a structure suitable for engaging with the lifting hook 212. For example, the attachment mechanism may include a metal loop or ring having an aperture. The utility engineer would, while holding the grip 216 of the multi-tool 100, insert the pry bar 210 through the aperture of the metal ring to thereby engage the metal ring with the lifting hook 212. Thereafter, the utility engineer would pull upward while holding the grip 216 of the multi-tool 200 to thereby open the vault door 104. The hammer face 208 or pry bar 210 of the multi-tool 200 may of course also be used as part of the process of opening, or closing, the vault door 104, such as utilizing the hammer to dislodge rusted components of the access device 116 or pry the vault door from a structure of the equipment vault 100 on which the door rests when closed. All of these functions may be performed by the utility engineer with the single multi-tool 200 instead of multiple individual tools that would otherwise need to be carried by the engineer. The various components of the multi-tool 200 may, of course, be used by the utility engineer in applications other than the opening of a vault door of an equipment vault. The hammer face 208 and pry bar 210 may be utilized by the engineer in any situation encountered in the field by the engineer requiring hammering or prying functionality.

Figure 2C:
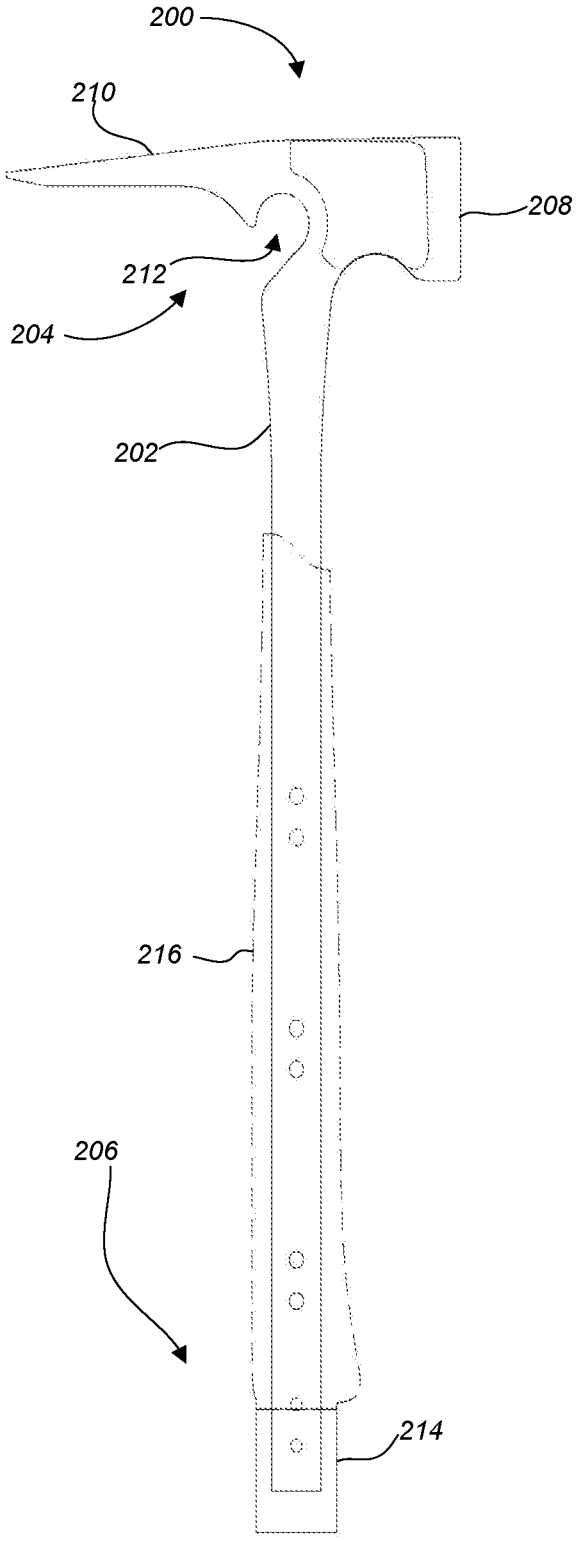
FIG. 2C is a first side view of the multi-tool of FIGS. 2A and 2B.
Figure 2D:
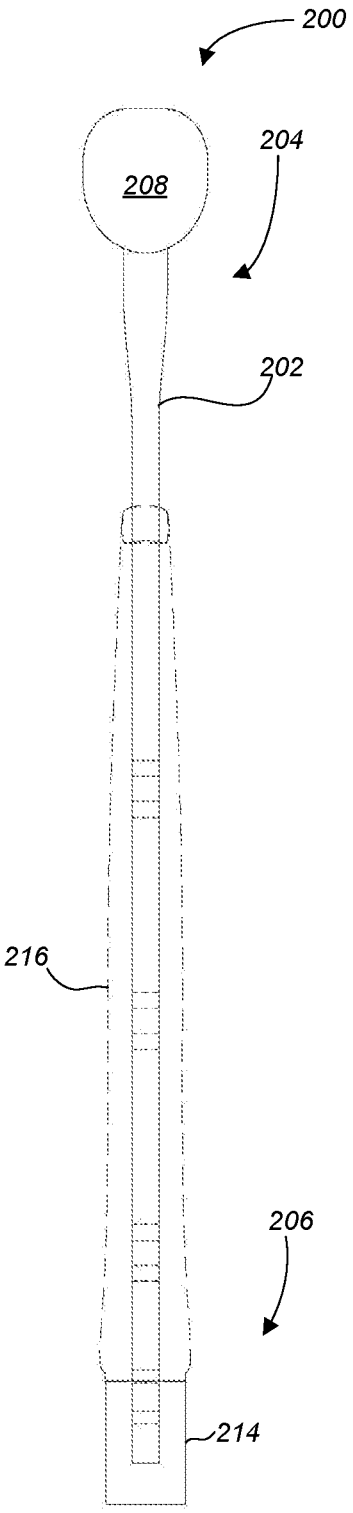
FIG. 2D is a front view of the multi-tool of FIGS. 2A and 2B.
Figure 2E:
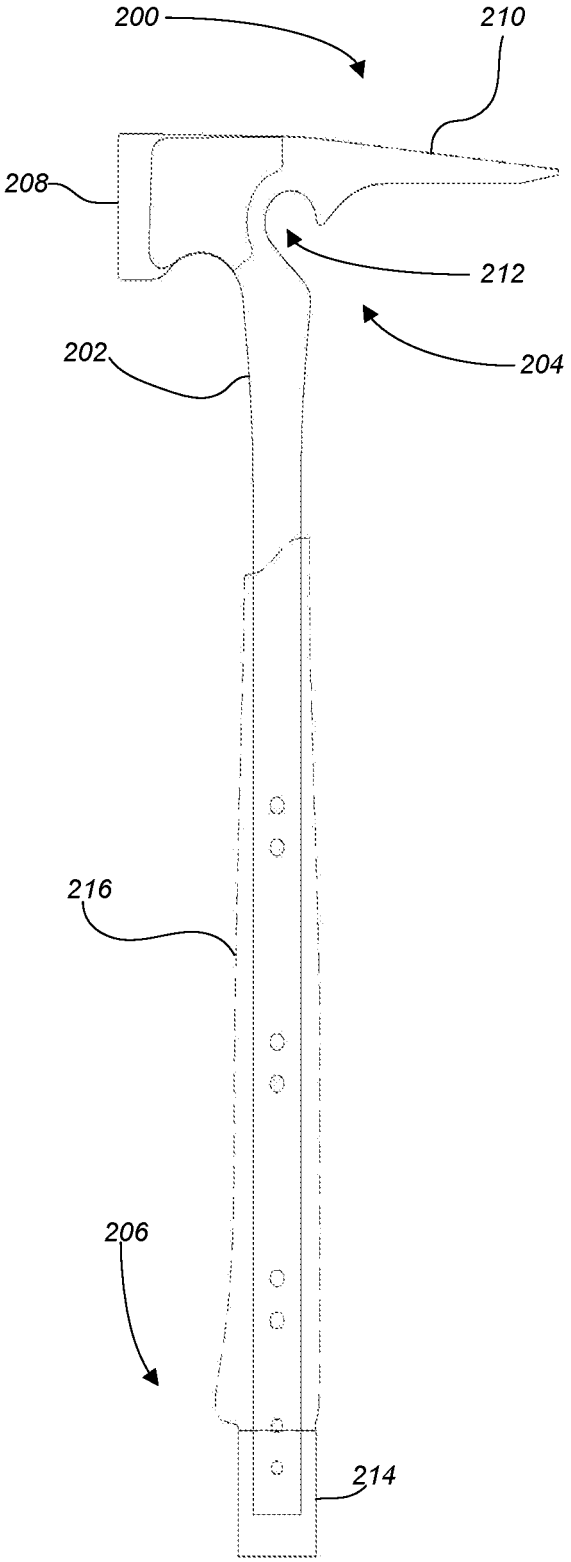
FIG. 2E is a second side view of the multi-tool of FIGS. 2A and 2B.
Figure 2F:
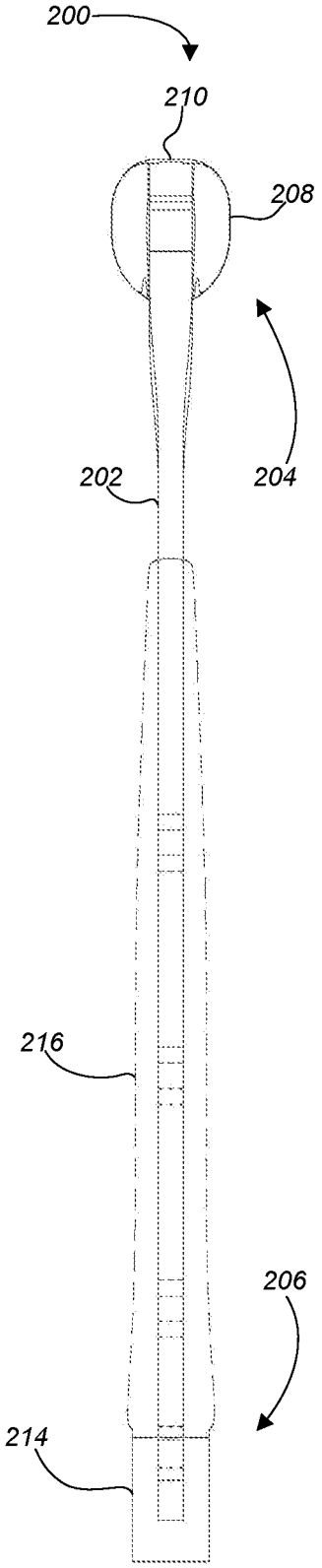
FIG. 2F is a back view of the multi-tool of FIGS. 2A and 2B.
Figure 2G:
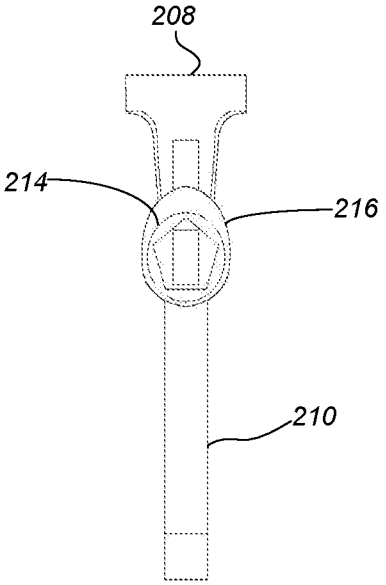
FIG. 2G is a bottom view of the multi-tool of FIGS. 2A and 2B.
Figure 2H:
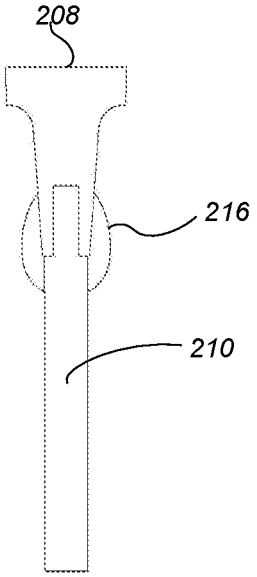
FIG. 2H is a top view of the multi-tool of FIGS. 2A and 2B.

FIG. 2C is a first side view of the multi-tool 200 of FIGS. 2A and 2B. This first side corresponds to the left side of multi-tool 200 in FIGS. 2A and 2B. FIG. 2D is a front view of the multi-tool 200. FIG. 2E is a second side view (i.e., right side view in the embodiments of FIGS. 2A and 2B) of the multi-tool 200. FIG. 2F is a back view of the multi-tool 200, FIG. 2G is a bottom view of the multi-tool, and FIG. 2H is a top view of the multi-tool.

Figure 3A:
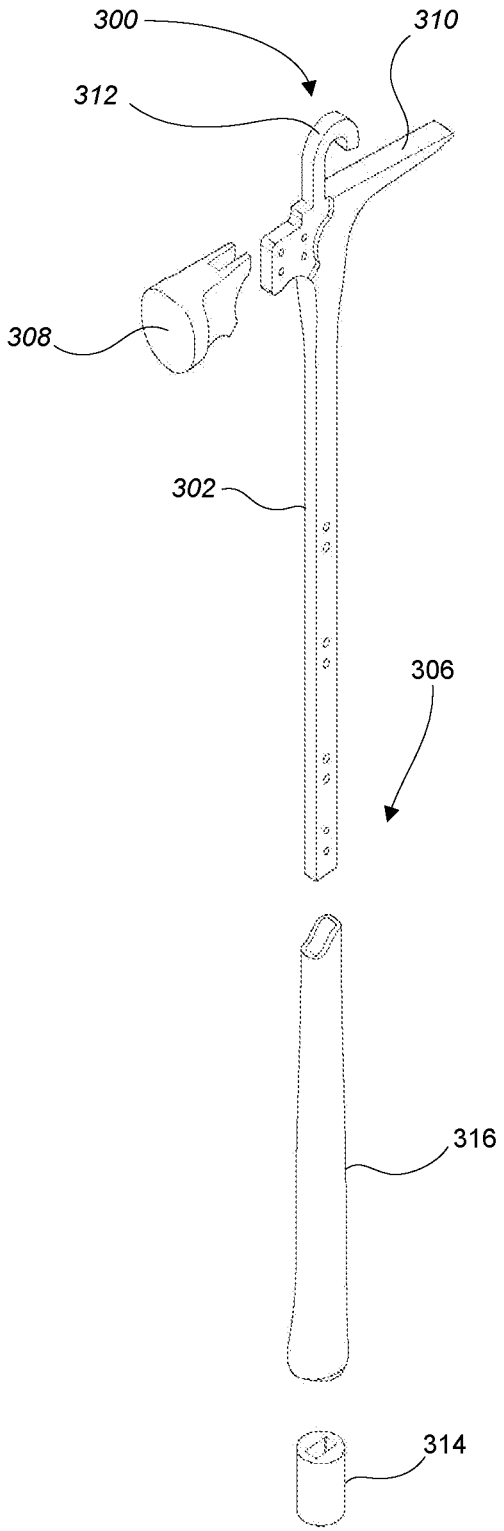
FIG. 3A is an exploded perspective view of a multi-tool according to a second embodiment of the present disclosure.
Figure 3B:
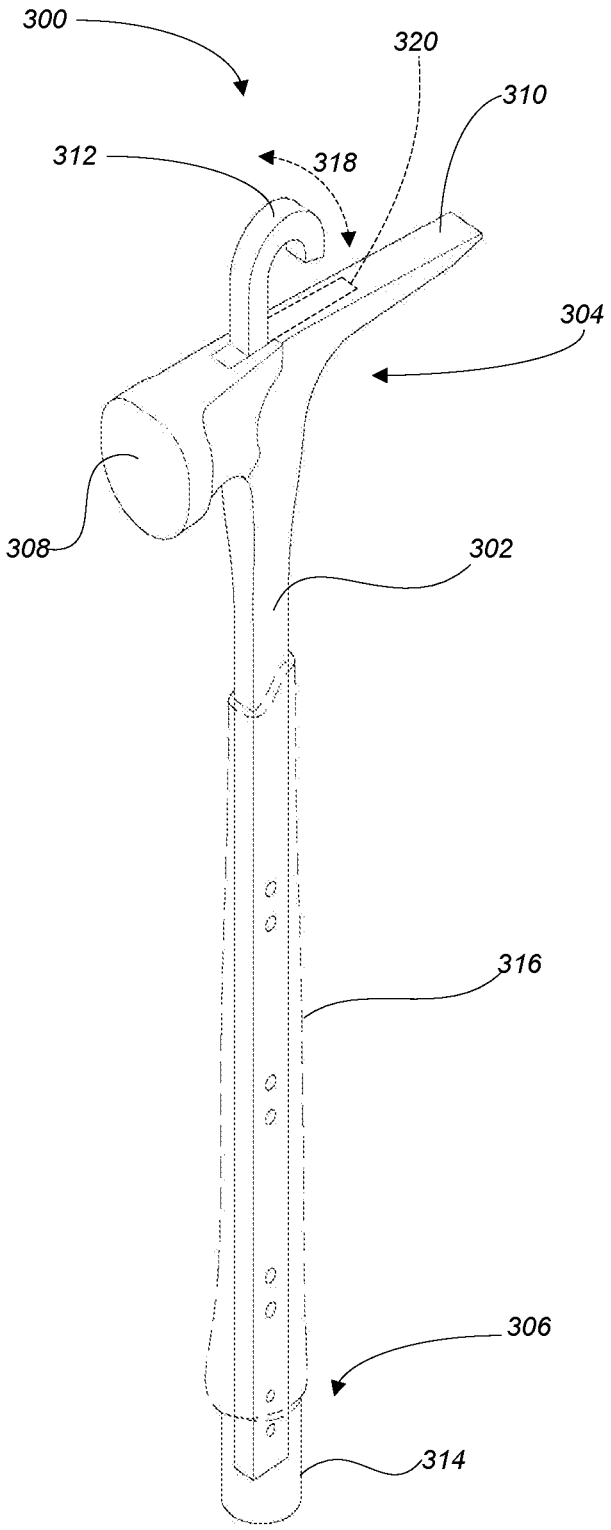
FIG. 3B is a perspective view of the multi-tool of FIG. 3A when the multi-tool has been assembled according to an embodiment of the present disclosure.

FIG. 3A is an exploded perspective view of a multi-tool 300 and FIG. 3B a perspective view of this multi-tool when assembled according to a second embodiment of the present disclosure. In the multi-tool 300, the multi-tool includes a handle 302 having a first end 304 and a second end 306 opposite the first end. A hammer face 308 is attached at the first end 304 of the handle 302 along with a pry bar 310. A lifting hook 312 is also attached or formed at the first end 304 of the handle 302. In the embodiment of FIGS. 3A and 3B the lifting hook 312 is formed extending from an upper portion of the pry bar 310. An enclosure or vault key 314 is attached at the second end 306 of the handle 302 and is utilized by a utility engineer to unlock an enclosure or vault containing equipment being serviced by the utility engineer, such as the equipment vault 100 of FIG. 1. A grip 316 is grasped by a utility engineer when utilizing the multi-tool 300 and is attached to surround a portion of the handle 302. The grip 316 is shown through a dashed line in FIG. 3B.

The multi-tool 300 may also be utilized to open and close equipment vault doors such as the vault door 104 of the equipment vault 100 of FIG. 1 in a similar as described above for the multi-tool 200. The utility engineer would again first utilize the vault key 314 to unlock the locking mechanism of the access device 116 and thereafter, while grasping the handle 316 would engage the lifting hook 312 with the attachment mechanism of the access device 116. The attachment mechanism of the access device 116 must, of course, have a structure suitable for engaging with the lifting hook 312. The attachment mechanism could once again include a metal loop or ring having an aperture so that the utility engineer may, while holding the grip 316 of the multi-tool 300, insert the pry bar 310 through the aperture of the metal ring to thereby secure the metal ring with the lifting hook 312. Thereafter, the utility engineer would pull upward while holding the grip 316 of the multi-tool 300 to thereby open the vault door 104. The multi-tool 300 also includes the hammer face 308 and the pry bar 310 which may be used, for example, as described above for the multi-tool 200 as part of the process of opening, or closing, the vault door 104. Once again, all of the functions may be performed by the utility engineer with the single multi-tool 300 instead of multiple individual tools that would otherwise be needed.

In embodiments of the multi-tool 300, the lifting hook 312 may be fixed extending from the upper portion or surface of the pry bar 310 or in an alternative embodiment the lifting hook may be retractable, namely extended from and retracted into the upper surface of the pry bar 310. This embodiment with the retractable lifting hook 312 is illustrated in FIG. 3B through the dashed arrow 318, illustrating rotation of the lifting hook about a base of the lifting hook 312 attached to the first end 304 of the handle 302. In operation, when extended the lifting hook 312 is positioned as shown in FIG. 3B. When retracted, the retractable lifting hook 312 retracts into a suitable opening 320 formed in the upper surface of the pry bar 310 upon application of a suitable force on the lifting hook by the utility engineer. This opening 320 is represented in FIG. 3B through dashed lines on the upper surface of the pry bar 310.

In embodiments of the multi-tool 300, the lifting hook 312 is fixed or permanently attached at the first end of the handle 302, or may be integrally formed at the first end, and extends from the upper surface of the pry bar 310. Alternatively, the lifting hook 312 is in other embodiments retractably attached at the first end 304 or pry bar 310 of the multi-tool 300. In such embodiments, the upper surface of the first end 304 of the handle 302, or the upper surface of the pry bar 310, includes the opening 320 configured to receive the lifting hook 312 when the lifting hook is retracted and pushed within the opening. When the engineer needs to use the lifting hook 312, the engineer may extend the lifting hooks by causing the lifting hook to be removed from the opening 320 to be positioned in the extended position as shown in FIGS. 3A and 3B. In these embodiments the lifting hook 312 may be rotatably attached to the first end of the handle 302 or may be attached so to linearly retract into or extend from the opening 320.

Figure 3C:
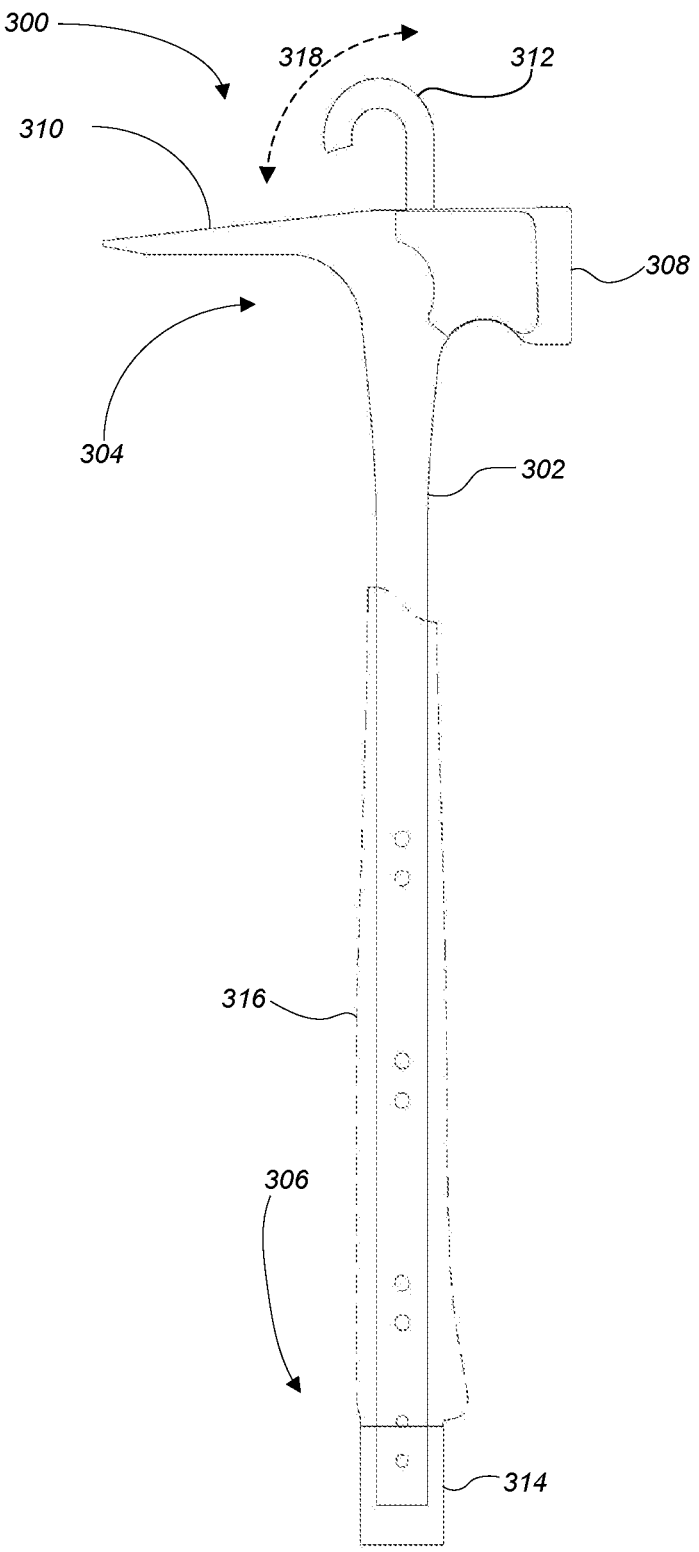
FIG. 3C is a first side view of the multi-tool of FIGS. 3A and 3B.
Figure 3D:
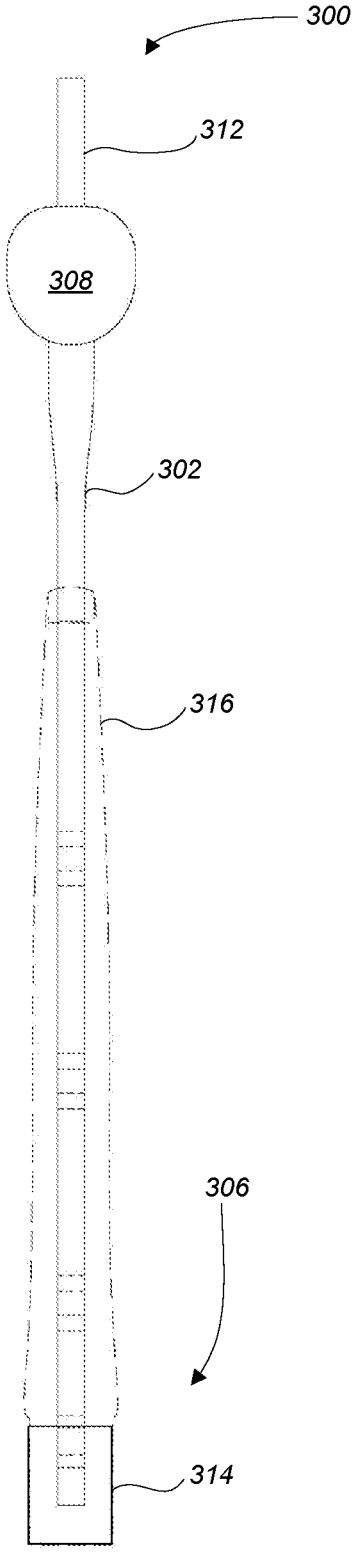
FIG. 3D is a front view of the multi-tool of FIGS. 3A and 3B.
Figure 3E:
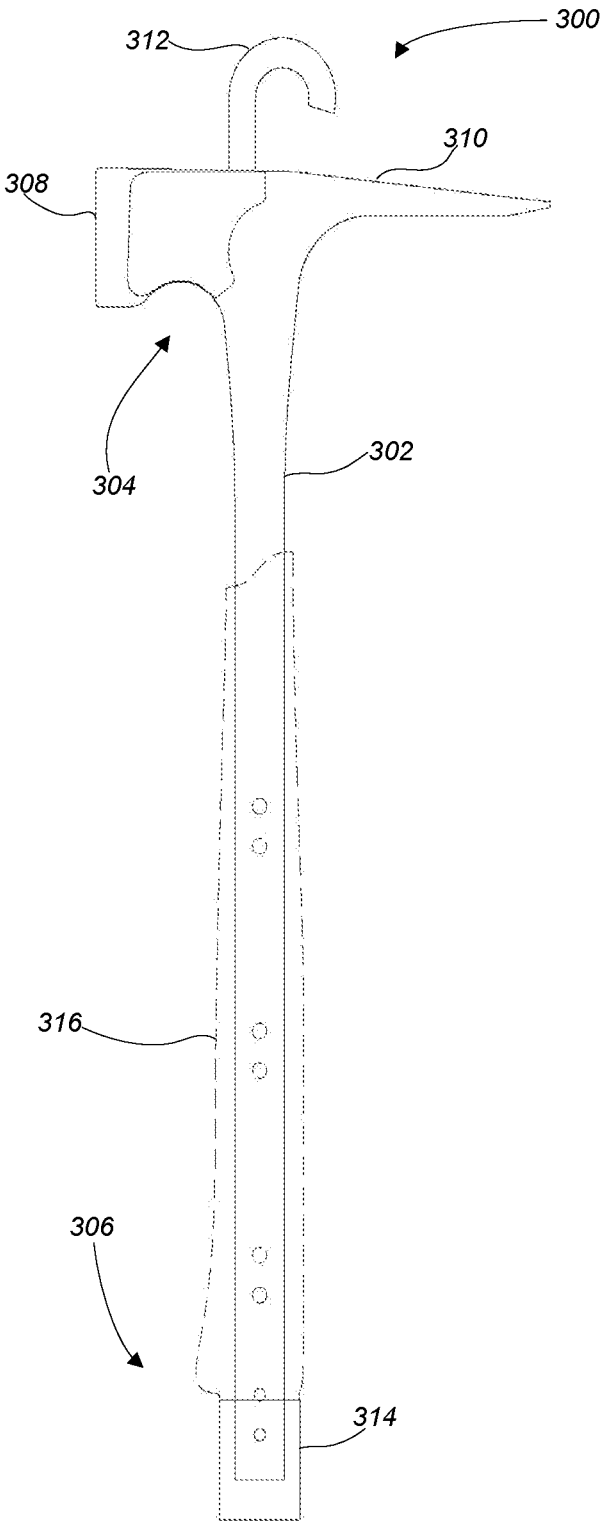
FIG. 3E is a second side view of the multi-tool of FIGS. 3A and 3B.
Figure 3F:
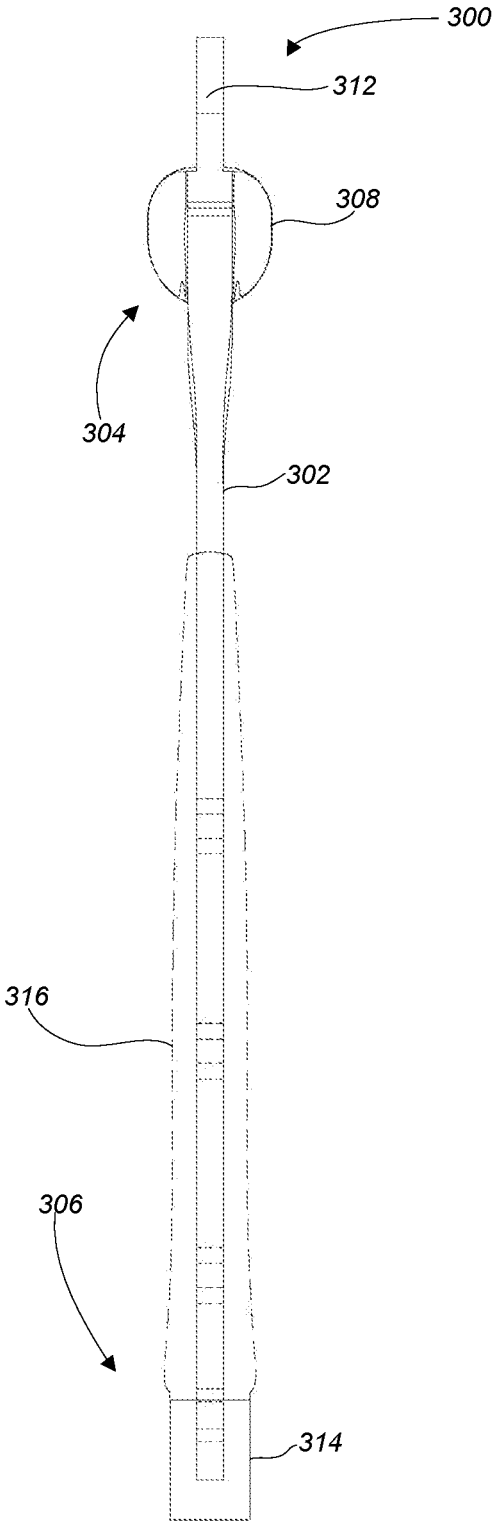
FIG. 3F is a back view of the multi-tool of FIGS. 3A and 3B.
Figure 3G:
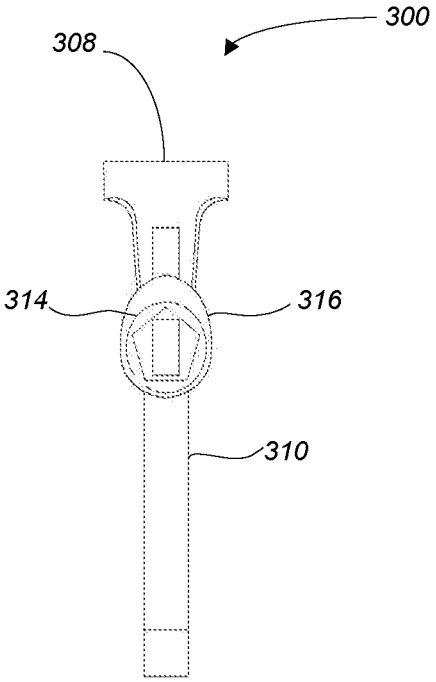
FIG. 3G is a bottom view of the multi-tool of FIGS. 3A and 3B.
Figure 3H:
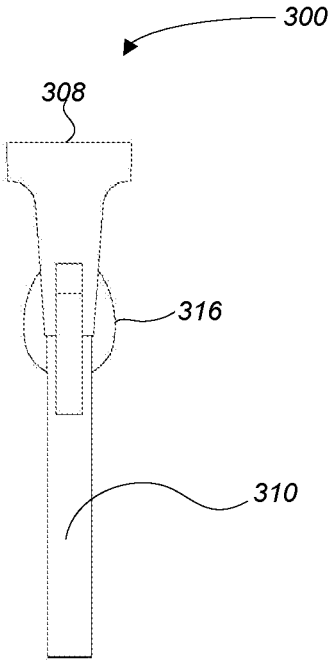
FIG. 3H is a top view of the multi-tool of FIGS. 3A and 3B.

FIG. 3C is a first side view (i.e., left side view) of the multi-tool 300 of FIGS. 3A and 3B. FIG. 3D is a front view of the multi-tool 300, FIG. 3E is a second side view (i.e., right side view) of the multi-tool, FIG. 3F is a back view of the multi-tool, FIG. 3G is a bottom view of the multi-tool, and FIG. 3H is a top view of the multi-tool.

Multi-tools according to additional embodiments of the present disclosure have different shapes and include additional or fewer individual components than the multi-tools 200 and 300 of FIGS. 2A-2H and 3A-3H. For example, the shapes of the hammer faces 208, 308, along with shapes of the pry bars 210, 310, handles 202, 302, grips 216, 316, and other components of the multi-tools 200, 300 may be different in further embodiments of the present disclosure. In embodiments where the vault keys 214, 314 are permanently attached at the second ends 206, 306 of the handles 202, 302, or are integrally formed at the second end of the handle, will of course be shaped as required to fit the locking mechanisms of the access devices 116 on the equipment vaults 100 to be opened using the multi-tool. In addition, in embodiments of the multi-tools 200, 300 the components of the multi-tool may be formed as integral parts of the handle 202, 302. Thus, the hammer faces 208, 308, pry bars 210, 310, lifting hooks 212, 312, and vault keys 214, 314 may be integrally formed as part of the handle 202, 302 in further embodiments of the present disclosure. In the embodiments of FIGS. 2 and 3, the hammer faces 208, 308 are shown as being attached to the pry bars 210, 310 through suitable securing devices, with holes being shown in the first ends 204, 304 of the handles 202, 302 where these holes are configured to receive securing mechanisms, such as screws, that are utilized to secure the hammer faces 208, 308 to the first ends 204, 302 of the handles 202, 302. In other embodiments, the hammer face 208, 308 may be attached in different ways, and may also be integrally formed at the first ends 204, 304 of the handles 202, 302 as previously mentioned.

Conditional language used herein, such as, among others, "can," "could," "might," "may," and the like, unless specifically stated otherwise, or otherwise understood within the context as used, is generally intended to convey that certain embodiments include, while other embodiments do not include, certain features, elements, and/or steps. Thus, such conditional language is not generally intended to imply that features, elements and/or steps are in any way required for one or more embodiments or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

The above description illustrates various embodiments of the present disclosure along with examples of how aspects of the particular embodiments may be implemented. The above examples should not be deemed to be the only embodiments, and are presented to illustrate the flexibility and advantages of the particular embodiments as defined by the following claims. Based on the above disclosure and the following claims, other arrangements, embodiments, implementations and equivalents may be employed without departing from the scope of the present disclosure as defined by the claims.

What is claimed is:

1. A multi-tool, comprising:

a handle having a first end and a second end opposite the first end;

a hammer face attached at the first end of the handle;

a pry bar attached at the first end of the handle and including an upper surface;

a lifting hook attached at the first end of the handle and extending from the upper surface of the pry bar; and a vault key attached at the second end of the handle.

2. The multi-tool of claim 1, wherein the lifting hook is retractably attached at the upper surface of the pry bar.

3. The multi-tool of claim 2 wherein the upper surface of the pry bar includes an opening that receives the lifting hook when the lifting hook is retracted and wherein the lifting hook extends from the opening when the lifting hook is extended.

4. The multi-tool of claim 1, wherein the lifting hook is formed as an integral part of the pry bar extending from the upper surface of the prior bar.

5. The multi-tool of claim 1, wherein the handle comprises an elongated body extending between the first end and the second end, and further comprises a grip attached to the body of the handle.

6. The multi-tool of claim 5, wherein the grip is attached to the body of the handle through securing devices.

7. The multi-tool of claim 6, wherein the securing devices comprise screws.

8. The multi-tool of claim 1, wherein the handle comprises metal.

9. The multi-tool of claim 1, wherein the vault key is removably attached to the second end of the handle.

10. A multi-tool, comprising:

a handle having a first end and a second end opposite the first end;

a hammer face attached at the first end of the handle;

a pry bar attached at the first end of the handle, the pry bar including an upper surface;

a lifting hook extending from the upper surface of the pry bar, wherein the lifting hook is fixed extending from the upper surface of pry bar; and a vault key attached at the second end of the handle.

11. The multi-tool of claim 10, wherein the vault key is removably attached to the second end of the handle.

12. The multi-tool of claim 11, wherein the grip is attached to the body of the handle through securing devices.

13. The multi-tool of claim 10, wherein the handle comprises an elongated body extending between the first end and the second end, and further comprises a grip attached to the body of the handle.

14. The multi-tool of claim 13, wherein the grip is configured to fit over the body of the handle and be secured in place on the body through forces developed between the grip and body of the handle when the grip is in place on the body.

15. A multi-tool, comprising:

a handle having a first end and a second end opposite the first end;

a hammer face attached at the first end of the handle;

a pry bar attached at the first end of the handle, the pry bar including an upper surface;

a lifting, hook extending from the upper surface of the pry bar, wherein the lifting hook is retractably attached to the pry bar, and wherein the upper surface of the pry bar includes an opening configured to receive the lifting hook when the lifting hook is retracted and wherein the lifting hook extends from the opening when the lifting hook is extended.

16. The multi-tool of claim 15, wherein the lifting hook is rotatably attached to the pry bar.

* * * * *